US005285736A

United States Patent [19]

Sturniolo

[11] Patent Number: 5,285,736

[45] Date of Patent: Feb. 15, 1994

[54] PRESSURE RELIEF APPARATUS FOR A VESSEL

[75] Inventor: Thomas F. Sturniolo, Rock Hill, S.C.

[73] Assignee: Joy Technologies Inc., Pittsburgh, Pa.

[21] Appl. No.: 993,125

[22] Filed: Dec. 18, 1992

[51] Int. Cl.[5] ..... F23M 11/00

[52] U.S. Cl. ..... 110/179; 110/173 A; 432/242

[58] Field of Search ..... 110/173 R, 173 A, 173 B, 110/180, 179; 432/242, 237

[56] References Cited

U.S. PATENT DOCUMENTS

| | | | |
|---|---|---|---|
| 2,517,816 | 8/1950 | Weyenberg et al. | 110/75 |
| 2,623,482 | 12/1952 | Ayers | 110/173 |
| 3,457,881 | 7/1969 | Test et al. | 110/7 |
| 3,667,409 | 6/1972 | Motz et al. | 110/173 A |
| 4,016,045 | 4/1977 | Van Ackeren | 202/242 |
| 4,054,411 | 10/1977 | Beck | 432/242 |
| 4,145,259 | 3/1979 | Leumann | 110/173 R |
| 4,200,498 | 4/1980 | Dinello | 202/248 |
| 4,284,479 | 8/1981 | Schulte | 202/248 |
| 5,029,533 | 7/1991 | Hengelmolen | 110/181 |
| 5,193,998 | 3/1993 | Hack et al. | 110/173 R |

*Primary Examiner*—Henry C. Yuen

*Attorney, Agent, or Firm*—Kirkpatrick & Lockhart

[57] ABSTRACT

A pressure relief door for an enclosed vessel such as a combustion chamber for an incinerator. The door is pivotally attached to the combustion chamber and is movable between a closed position wherein it confronts and seals a vent duct attached to the chamber and an open position wherein said vent duct is unsealed to permit excessive pressure to be relieved from the chamber. A liquid holding trough is attached around the perimeter of the duct and is adapted to retain therein a liquid at a predetermined level. A seal member is attached around the perimeter of the door and is adapted to extend into the liquid to achieve an airtight seal between the door and duct when the door is in a closed position.

9 Claims, 5 Drawing Sheets

Fig.5.
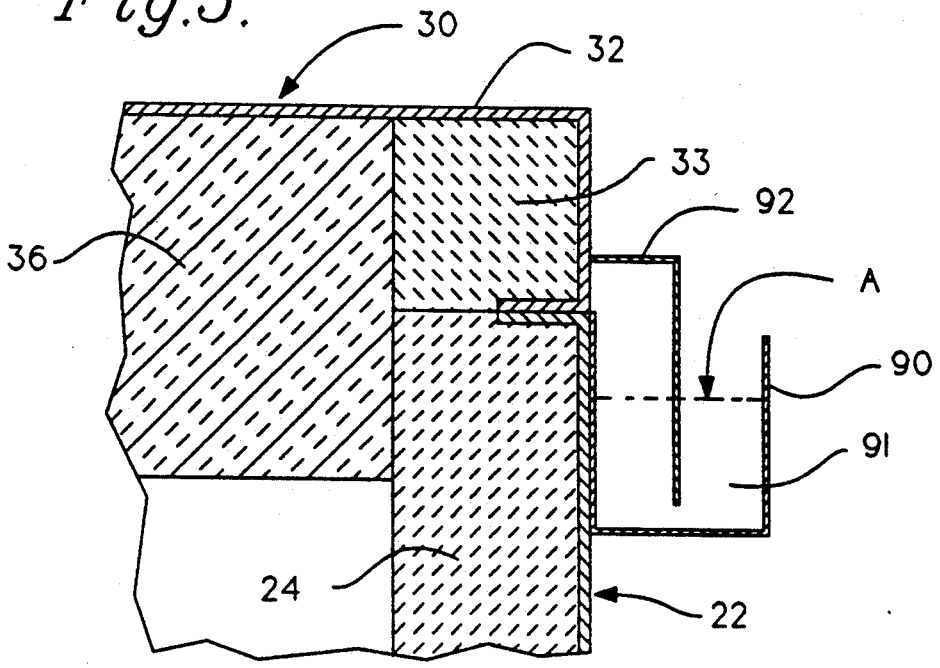
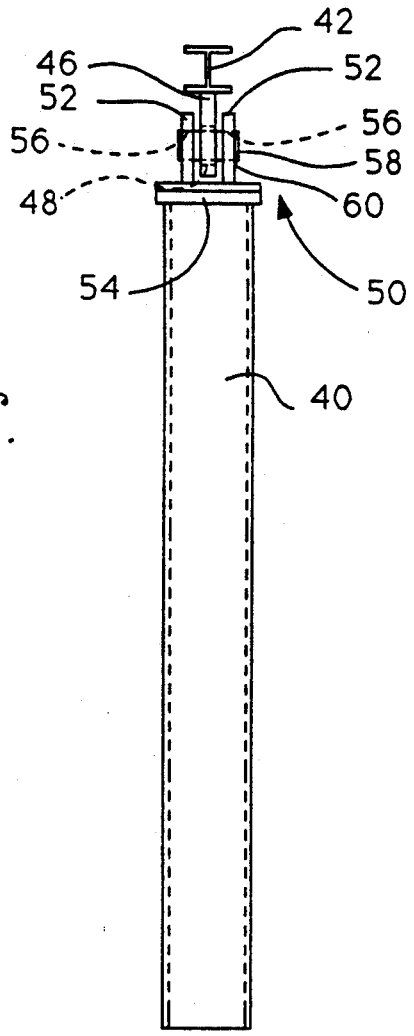
Fig.6.
Fig.7.
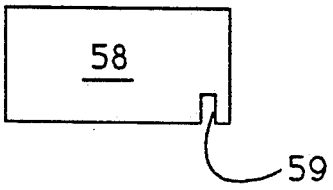

PRESSURE RELIEF APPARATUS FOR A VESSEL

BACKGROUND OF THE INVENTION

1. Field of the Invention

The present invention relates to pressure relief apparatus and, more particularly, is directed to pressure relief doors for combustion vessels.

2. Description of the Invention Background

A variety of industrial systems exist wherein a pressurized liquid or gaseous medium is contained therein. For example, industrial boiler systems used to create steam for heating facilities must accommodate water and steam at varying temperatures and pressures. The pressure within those systems can, at times and for a variety of reasons, reach a magnitude wherein it must be reduced to prevent equipment damage and/or injury to personnel. Thus, a variety of valves and pressure relief apparatuses have been developed to permit the pressure to be relieved from the system when it reaches a potentially harmful magnitude.

Another industrial system that must be equipped with pressure relief apparatus is the combustion chamber that is used in connection with a number of different heating apparatuses such as furnaces and incinerators. Because those combustion chambers are typically used to burn a variety of different materials, some of which may be explosive in nature, it is possible for explosions to occasionally occur within the chamber. Such explosions cause a rapid increase of pressure within the chamber such that, if the excessive pressure is not relieved therefrom, the chamber could rupture and possibly injure personnel that are in the general vicinity of the incinerator. It is for that reason that the National Fire Protection Association (the "NFPA") requires incinerators to be equipped with apparatus adapted to quickly and safely relieve excessive combustion chamber pressures resulting from explosions occurring therein. In particular, NFPA regulations require the unit's primary combustion chamber to be equipped with a vent opening that provides at least one square foot of relief area per one hundred cubic feet of combustion chamber volume.

In incineration applications, in order to achieve proper temperature control within the combustion chamber to thereby ensure complete combustion of the material and to prevent the smoke and volatile gases that are created during the combustion process from leaking into the atmosphere, the combustion chamber must be maintained in an airtight condition. As such, in addition to being able to quickly and safely relieve excessive pressure from the combustion chamber, pressure relief apparatus used in connection with incinerators must also be capable of maintaining the airtight integrity of the combustion chamber under normal incineration pressures.

To address such concerns and requirements, a variety of explosion relief doors have been developed for use in connection with heating units and incinerator combustion chambers. For example, Weyenberg et al. U.S. Pat. No. 2,517,816 discloses an explosion relief door that is hingably attached to the combustion chamber such that it can swing open in response to an increase of pressure within the chamber. After the pressure has been relieved from the chamber, the door, by virtue of gravity, returns to a closed position. That apparatus, however, fails to provide means for maintaining an airtight seal between the door and the chamber when the door is in the closed position.

Another pressure relief door arrangement is taught in Ayers U.S. Pat. No. 2,623,482. The pressure relief door disclosed therein is adapted to cover a vent opening provided in the heating unit. The door is pivotally received on the lower portion of the opening and is equipped with a counterweight portion that serves to maintain the door in a closed position. An excessive amount of pressure within the unit will cause the door to pivot to an open position and thus relieve the pressure therefrom. After the excessive pressure has been relieved from the unit, the counterweight causes the door to pivot to a closed position. That pressure relief door is also not equipped with sealing apparatus that is capable of achieving an airtight seal between the door and the unit when the door is in a closed position.

To address such air leakage concerns, some incinerator pressure relief doors have been equipped with gasket seals that serve to provide an airtight seal between the door and the chamber when the door is in the closed position. However, as those gaskets begin to wear, air is permitted to enter into or pass out of the combustion chamber thus making it difficult to control the temperature therein.

Other incinerators are provided with pressure relief through their ash removal apparatus. In particular, some incinerators are equipped with a liquid filled trough at one end that is adapted to collect ash material therein. The end of the incineration chamber extends into and below the surface of the liquid to create a barrier to prevent air flow into or out of the incineration chamber. As the ash accumulates in the trough, it can be removed therefrom without disturbing the incineration process. In addition, trough arrangement also provides a means for relieving excessive pressures from within the combustion chamber. For example, a rapid increase in pressure caused by an explosion within the chamber will cause the displacement of the liquid and thereby permit the excessive pressure to exit the chamber. That arrangement, however, is not necessary for incinerators wherein frequent ash removal is not required.

Other sealing apparatuses and arrangements have been developed for achieving a seal between a door and a combustion chamber or heating unit. For example, the seal arrangement disclosed in Van Ackeren U.S. Pat. No. 4,016,045 applies a vacuum between the door and the oven to channel away any gas that may leak from the oven. Conversely, Beck U.S. Pat. No. 4,054,411 discloses a furnace door seal wherein a sealing gas is introduced between the confronting surfaces of the door and the oven to establish a gas barrier to prevent the combustion gases from leaking into the atmosphere. Both of those sealing arrangements, however, could have an adverse affect upon the stability of the pressure within the heating unit by either adding foreign gas into the unit or withdrawing combustion gas from the unit which could be hazardous.

Yet another sealing arrangement is disclosed in Schulte U.S. Pat. No. 4,284,479. The sealing arrangement includes a door body having an inner peripheral face that is arranged to confront a door frame provided around an opening in the oven. When in a closed position, the door body faces the door frame and is spaced therefrom to provide a channel for receiving a fluid sealing medium such as loam or coking duff that is injected therein. However, each time the door is opened, the sealant material must be cleaned from the door frame so that new material may be injected into the channel after the door has been closed. Therefore, this sealing arrangement would be ill-suited for incinerator applications wherein it is desirable for the relief door to quickly re-achieve an airtight seal between the door and the combustion chamber after an excessive amount of pressure has been relieved therefrom.

Thus, there is a need for a pressure relief apparatus that is capable of quickly relieving excessive amounts of pressure from an enclosed vessel such as a combustion chamber for an incinerator and that is also equipped with sealing apparatus that is capable of quickly re-achieving and maintaining the airtight integrity of the vessel after the excessive pressure has been relived therefrom.

SUMMARY OF THE INVENTION

In accordance with the particular preferred form of the present invention, there is provided apparatus for relieving the pressure from an enclosed vessel having a vent opening therein. The apparatus includes a door that is attached to the vessel and is movable between a closed position wherein it is in sealing engagement with the vent opening and an open position wherein the vent opening is unsealed so that excessive pressure may be relieved therefrom. The door is attached to the vessel such that upon the occurrence of a predetermined amount of pressure within the vessel, the door will move to the open position. The apparatus, in its preferred form, also includes a liquid holding trough adapted to retain a liquid medium at a predetermined depth around the perimeter of the vent opening. Seal members are attached to the door such that they extend into the liquid medium when the door is in the closed position to create an airtight or hermetic seal between the door and the vessel.

It is an object of the present invention to provide a means for quickly and safely relieving excessive pressure from an enclosed, normally airtight vessel such as a combustion chamber for an incinerator. It is a further object of the present invention to provide pressure relief apparatus that is capable of quickly re-achieving and maintaining the airtight integrity of the vessel after the excessive pressure has been relieved therefrom.

Accordingly, the present invention provides solutions to the aforementioned problems encountered with known pressure relief apparatuses used in connection with enclosed vessels such as incinerator combustion chambers. These and other details, objects and advantages will become apparent as the following detailed description of the present preferred embodiment thereof proceeds.

BRIEF DESCRIPTION OF THE DRAWINGS

In the accompanying drawings, I have shown a present preferred embodiment of the invention wherein like reference numerals are employed to designate like parts and wherein:

FIG. 5 is a partial cross-sectional view of the present pressure relief door and the vent duct of the incinerator depicted in FIG. 1;

FIG. 6 is an elevational view of the support members of the present invention; and FIG. 7 is a side view of a pivot rod of the present invention.

DETAILED DESCRIPTION OF THE PREFERRED EMBODIMENTS

Figure 1:
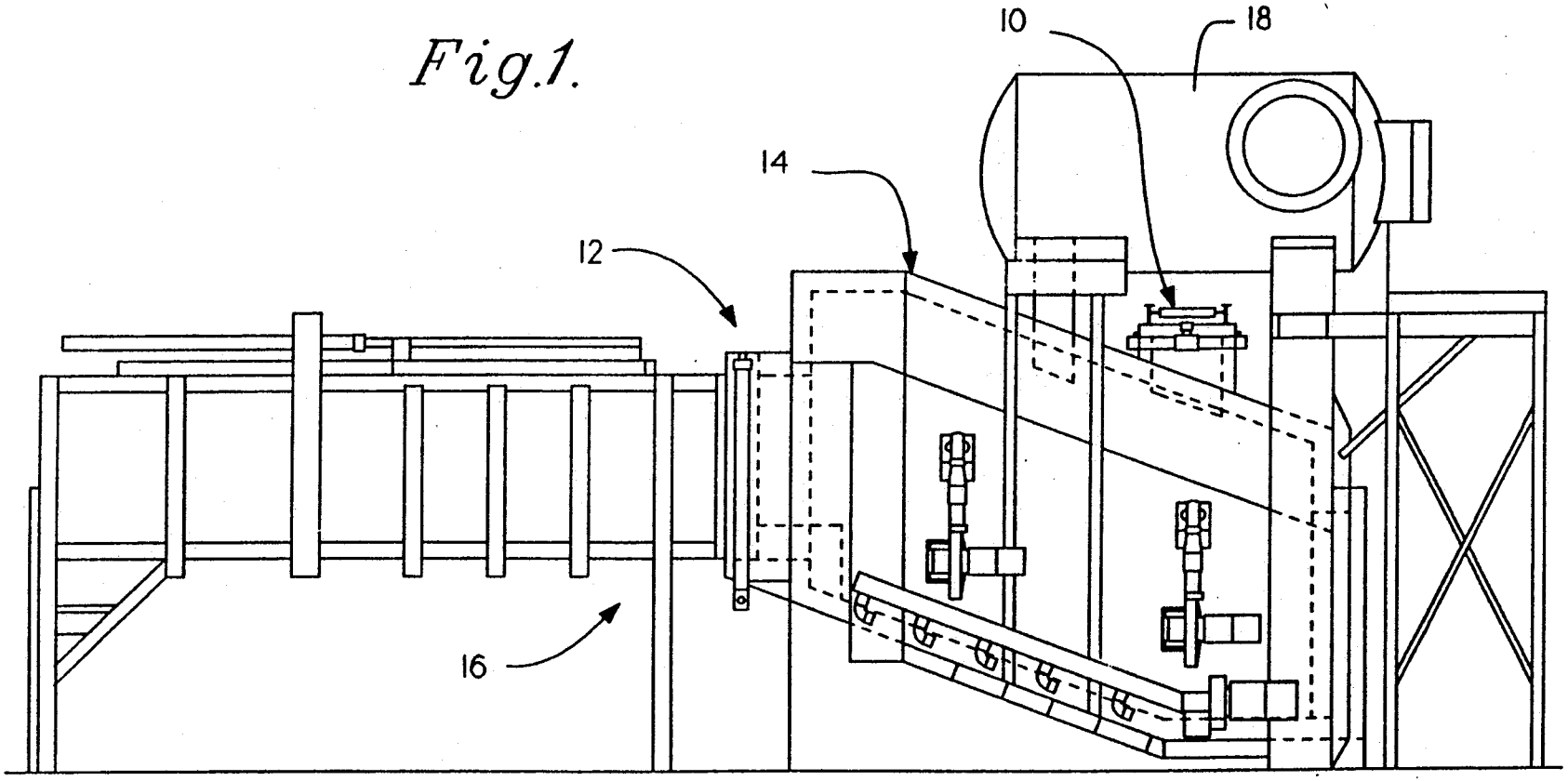
FIG. 1 is a front elevational view of the pressure relief apparatus of the present invention as attached to the primary combustion chamber of an incinerator.

Referring now to the drawings for the purposes of illustrating the present preferred embodiment of the invention only and not for purposes of limiting the same, the Figures show a pressure relief apparatus generally designated as 10 which is intended for use in connection with incinerator combustion chambers. It will be appreciated, however, that the pressure relief apparatus 10 may easily be adapted for relieving excessive pressure within a variety of other vessels without departing from the principle and scope of the present invention.

More particularly and with reference to FIG. 1, there is shown a pressure relief apparatus 10 that is attached to the primary combustion chamber 14 of an incinerator 12. The basic structure and operation of the incinerator 12 is similar to the incinerator described in my co-pending U.S. patent application Ser. No. 974,190, entitled "Incineration Apparatus and Method of Operating Same", the disclosure of which is herein incorporated by reference. As such, in the Present Detailed Description of the Preferred Embodiments, the basic structure of the incinerator 12 will be described in general terms, it being understood that the particular details of the incinerator 12 construction, with the exception of those features which are described hereinbelow forming the present invention, may be gleaned from a review of that application.

The incinerator 12 is equipped with a generally airtight primary combustion chamber 14 for receiving and incinerating therein a variety of materials. More specifically, the materials to be incinerated are loaded into the primary combustion chamber 14 by a loading apparatus generally designated as 16. After the material has been loaded into the primary combustion chamber 14, the material is heated to begin the combustion thereof. As the material burns, smoke and volatile gasses are driven therefrom. As the volatile gases and smoke are driven from the material, they pass into a secondary combustion chamber 18 wherein they are incinerated before being vented into the atmosphere. To prevent the smoke and volatile gases from leaking into the atmosphere, a small amount of vacuum (i.e., −0.1 inches of water column) is preferably applied to the primary combustion chamber 14 by the stack (not shown) which is in flue communication with secondary chamber 18.

Figure 2:
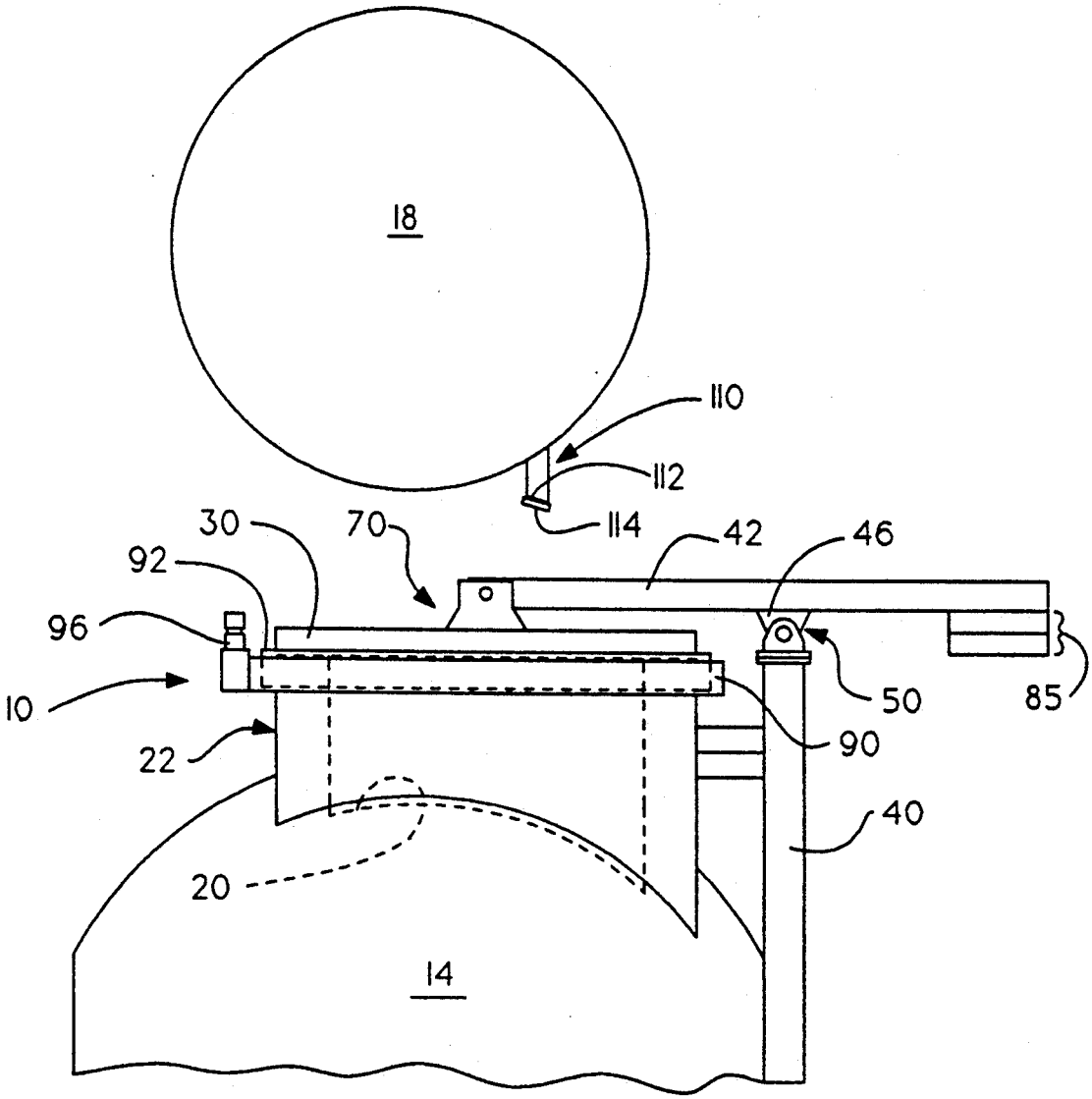
FIG. 2 is a right side elevational view of the pressure relief apparatus of FIG. 1 in a closed position.
Figure 3:
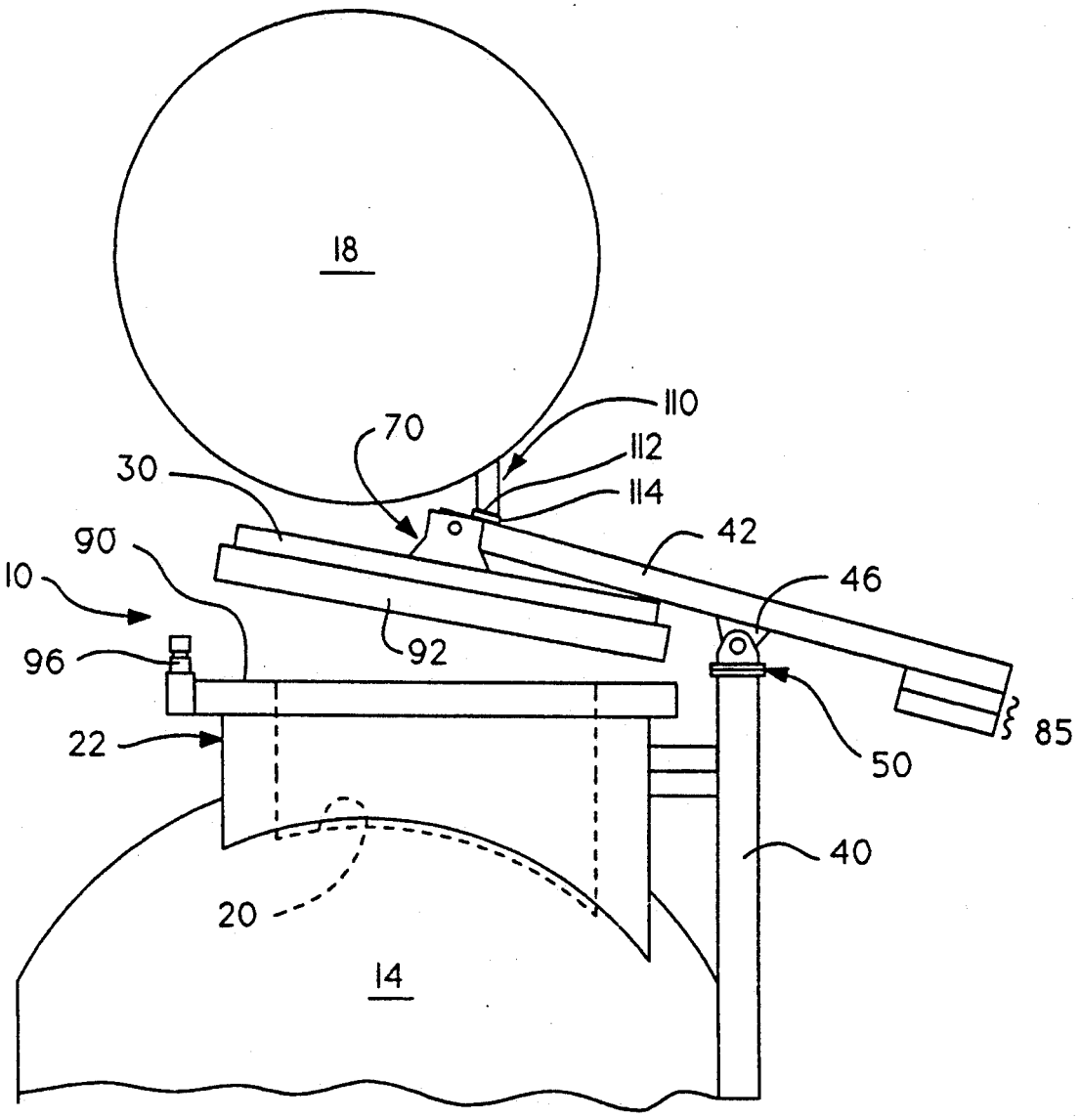
FIG. 3 is a right side elevational view of the pressure relief apparatus of FIG. 1 in an open position.
Figure 4:
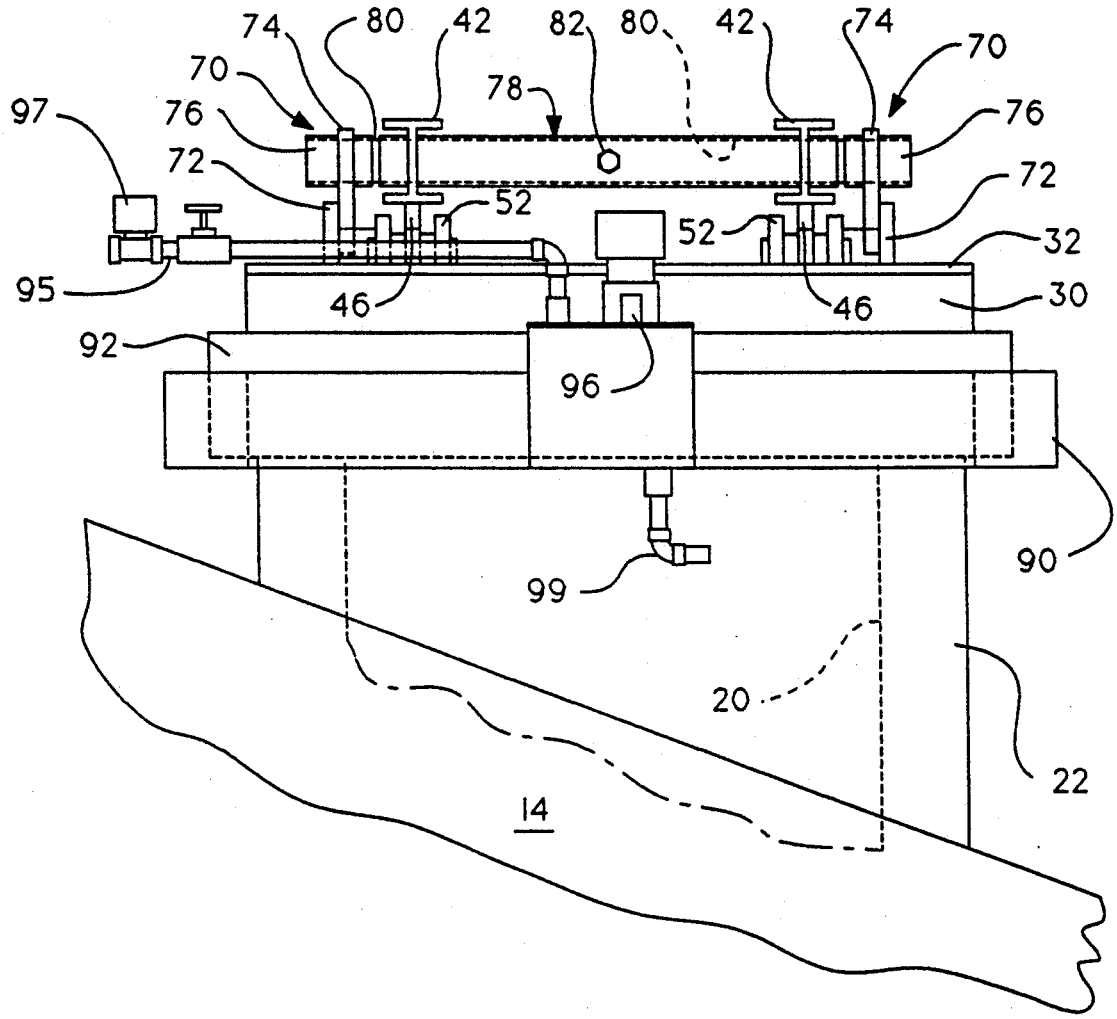
FIG. 4 is an enlarged front elevational view of the pressure relief apparatus of the present invention.

The pressure relief apparatus 10 of the present invention is attached to the upper portion of the primary combustion chamber 14 as is most particularly shown in FIG. 1. As will become evident from the discussion below, the pressure relief apparatus 10 of the present invention is well-adapted for relieving excessive pressure within the primary combustion chamber 14 that can be caused by explosions that occur during combustion of the waste material. As shown in FIGS. 2-4, a vent opening 20 is provided in the upper portion of the primary incineration chamber 14. In order to satisfy the NFPA requirements, the vent opening 20 must be sized to provide one square foot of relief area per one hundred cubic feet of volume within the primary chamber 14. Surrounding the vent opening 20 is a hollow steel duct 22 that is lined, via known casting methods, with a castable refractory material 24 such as the 28LI castable refractory material manufactured by Carolina Refractories. See FIG. 5.

The pressure relief apparatus 10 of the present invention includes a door member 30 that is sized to completely cover the top of the duct 22 and thereby seal the opening therethrough. The door member 30 preferably has a steel outer skin portion 32 that is configured as shown in FIG. 5. Also, because it is desirable to prevent heat loss through the door member 30 and to keep the weight of the door member 30 minimized, the door member 30 is preferably lined with insulation blanket modules 36, such as Fiberfrax Fiberwall Modules as manufactured by Carborundum Company and the perimeter of the door is lined with refractory material 33, which is like refractory material 24. The insulation material 36 is preferably attached to the door skin 32 by impaling it onto a collection of welded anchors with push-on retainers (not shown). However, a myriad of other known fastening means may be employed to fasten the insulation material 36 to the door skin 32. In order to further prevent heat loss through the door member 30, the insulation material 36 should be installed such that it protrudes into the opening of duct 22 to abut the refractory material 24 lining the duct 22 when the door member 30 is in the closed position. See FIGS. 2 and 5. However, such abutting arrangement between the insulation 36 and the refractory material 24 of duct 22 must not be so tight so as to impair the opening of the door member 30 upon the occurrence of a predetermined amount of pressure within the combustion chamber 14. It will be appreciated, of course, that the refractory material 33 and the insulation material 36 may be omitted for applications wherein temperature and heat loss through the door member 30 is not an important consideration.

In the preferred embodiment, as shown in FIGS. 2 and 3, two upstanding support members 40 are attached to the sides of the primary chamber 14 for pivotally supporting the door member 30 thereon. The door member 30 is pivotally attached to the primary combustion chamber 14 via two pivot struts 42 that are pivotally attached to the upstanding support members 40. The pivot struts 42 preferably consist of steel I-beam members, however, other compatible structural members may be used. The pivot struts 42 are attached to the upstanding support members 40 via corresponding clevis assemblies generally designated as 50. See FIGS. 2, 3, and 6. As most particularly shown in FIG. 6, each clevis assembly 50 includes two upstanding side plates 52 that are welded to a support plate 54 that is adapted to be bolted to the top of a corresponding upstanding support member 40. Each side plate 52 has an aperture 56 therethrough that is adapted to receive a corresponding pivot rod 58 therein. As shown in FIG. 6, each pivot strut 42 has attached thereto a downwardly extending plate member 46 that is configured to receive and retain a bearing member 48 capable of rotatably supporting a pivot rod 58 therein. I have found the Superoilite bearings manufactured by the Chrysler Corporation to be well-suited for this purpose, however, other bearings can also be used. As shown in FIG. 7, each pivot rod 58 preferably has a groove 59 therein adapted to receive a portion of retaining plate 60 therein. In the preferred embodiment, each retaining plate 60 is bolted to its corresponding side plate 52. It will therefore be appreciated that such clevis assemblies 50 serve to rotatably fasten the pivot struts 42 to the upstanding support members 40. The skilled artisan will readily appreciate, however, that pivot struts 42 may be pivotally attached to the upstanding support members 40 by a myriad of other known attachment means.

As can be seen in FIGS. 2–4, one end of each pivot strut 42 is also pivotally attached to the door member 30 via corresponding pivot assemblies generally designated as 70. Each pivot assembly 70 includes an upstanding plate member 72 that is preferably welded to the skin 32 of the door member 30 as most particularly shown in FIG. 4. A second support plate 74 is bolted to each plate member 72 and has attached thereto a section of hollow conduit 76. A cross support member 78 consisting of hollow conduit having the same inner diameter as conduits 76 is preferably welded between pivot struts 42. A rod member 80 is rotatably received within conduits 76 and 78 and is pinned to conduit 78 via a bolt 82. It will be appreciated that such arrangement serves to pivotally attach the pivot struts 42 to the door member 30. It will be further appreciated, however, that other known fastening means may be employed to pivotally attach the door member 30 to the pivot struts 42.

The skilled artisan will also appreciate that the door member 30, under the force of gravity, will remain in the closed position illustrated in FIG. 2 under normal operating pressures within the primary combustion chamber 14 (i.e., −0.1 inches of water column). However, when the pressure within the chamber 14 increases to a magnitude wherein it can overcome the weight of the door member 30, the door member 30 will pivot to an open position (See FIG. 3) and thus relieve the pressure within the chamber 14 to a magnitude wherein it can no longer overcome the weight of the door member 30 and the door member 30 will then return to the closed position.

I have found that by adding counterweights to the free ends of the pivot struts 42, the door member 30 can be made to swing open in response to variety of different pressure increases within the chamber 14. More specifically, in the preferred embodiment, counterweights in the form of steel plates 85 are attached to the ends of the pivot struts 42, for example, by bolting or welding. The skilled artisan will readily appreciate that by increasing the amount of counterweights, the door member 30 will be caused to open in response to smaller increases in pressure within the chamber 14.

In order to create a substantially airtight or hermetic seal between the door member and the upper portion of the duct 22, the present invention employs a liquid holding trough 90 that is attached around the perimeter of duct 22 as most particularly shown in FIGS. 2, 3, and 5. The liquid holding trough 90 is preferably fabricated from stainless steel plate and welded to the upper portion of the duct 22. However, trough 90 may be fabricated from any suitable material and attached to duct 22 by any compatible fastening means. In the preferred embodiment, trough 90 has a cross-sectional "U"-shape and is approximately 4" wide and 4.5" high. However, other trough sizes and configurations may also be used. The trough member 90 is adapted to contain a liquid medium 91 such as, for example, water or a water/glycol mixture at a level of preferably 3 inches as indicated by "A" in FIG. 5. I find it preferable that the liquid 91 have a freezing point below that of water and/or an evaporation or boiling point above water.

Cooperating with trough 90 is a seal member 92 that is attached around the entire perimeter of the door member 30 and is configured to extend into the liquid when the door member 30 is in the closed position. In the preferred embodiment, seal member 92 consists of a piece of 11 gauge stainless steel plate that is attached to the perimeter of the door member 30 preferably by welding. However, seal member 92 may be fabricated from a variety of other materials and be attached to the door member 30 by other known fastening means provided that an airtight seal is achieved between the seal member 92 and the perimeter of the door member 30. To ensure that an airtight seal is maintained between the door member 30 and the duct 22, I prefer that the seal member 92 extends into the liquid for a distance of at least 2 inches below level "A". It will be appreciated, however, that as long as the seal member 92 extends into the liquid, a substantially airtight seal will be achieved between the door member 30 and the duct 22.

In the preferred embodiment, to maintain the liquid at level "A" within the trough 90, I prefer to utilize a commercially available float switch 96 to monitor the liquid level in the trough 90. Float switch 96 communicates with a commercially available solenoid valve 97 located in the liquid supply line 95 that controls the flow of the liquid to the trough 90. A drain line 99 may also be provided for draining the liquid from the trough 90 when the incinerator is not in use. See FIG. 4. It will be appreciated that the aforementioned liquid sealing arrangement permits the door member 30 to rapidly pivot to an open position in response to an increase in pressure within the chamber 14 without impeding the opening and Closing thereof. After the pressure has been relieved from the chamber 14, the door member 30 will return to the closed position via gravity. As soon as the seal member 92 extends into the liquid medium, an airtight seal will once again be achieved between the door member 30 and the duct 22 thereby enabling the proper temperature and pressure to be quickly reattained within the chamber 14.

Because an explosion within the chamber 14 can cause a very rapid increase in pressure therein and thus cause the door member 30 to quickly pivot to an open position, or, in extreme cases, to be torn loose from its mounting arrangement, I prefer to use a damper or cushioning mechanism generally designated as 110 consisting of a striker plate 116 to limit the travel and restrain the door 30 when it is moved to an open position. As shown in FIGS. 2 and 3, the damper mechanism contains a second striker plate 112 that is preferably welded to the bottom of the secondary combustion chamber 18. Removably attached to the striker plate 112, via known fastening means such as, for example, by bolting or gluing, is an elastomeric material 114. I prefer to use a rubber material having a durometer value of approximately 70, however, other heat-resistant elastomeric material can also be used. The skilled artisan will also appreciate that other damping mechanisms such as shock absorbers and the like may also be used to cushion the door member 30 as it pivots to an open position.

In the operation of the pressure release apparatus 10 of the present invention, the door member 30 is in a first position in which it, preferably, seals the vent opening 20 against the flow of vapors. However, it will be appreciated that due to the inclusion of the liquid sealing means of the present invention, the seal between door member 30 and vent opening 20 need not necessarily be airtight. If an explosion occurs within primary incineration chamber 14, the pressure will almost immediately be transmitted to the inner surface of door member 30 thereby causing it to be moved from its position in engagement with vent opening 20. This will allow the seal member 92 to be removed from the liquid 91 and allow pressure to be vented from primary incineration chamber 14. The upward movement of the door member 30 will be limited by the elastomeric material 114 being contacted by the door member 30. Following the relief of the pressure from primary incineration chamber 14, the weight of the door member 30 causes it to be pivoted about clevis assembly 50 to its closed position in engagement with vent opening 20.

Accordingly, the present invention provides solutions to the aforementioned problems encountered with known explosion and pressure relief apparatuses used in connection with heating units and incineration chambers. In particular, the present invention provides a pressure relief door that can quickly respond to rapid increases in pressure yet preserve an airtight environment within the chamber during normal operating conditions. Nonetheless, it will be understood that various changes in the details, materials and arrangements of parts which have been herein described and illustrated in order to explain the nature of the invention may be made by those skilled in the art within the principle and scope of the invention as expressed in the appended claims.

I claim:

1. Apparatus for relieving pressure in an enclosed vessel having a vent opening therein comprising:

door means attached to said vessel and being movable between a closed position wherein said door means is in engagement with said vent opening and an open position remote from said vent opening wherein said vent opening is sufficiently open to relieve the pressure within said vessel when a predetermined amount of pressure occurs within said vessel;

liquid holding means attached to said vessel for retaining a liquid at a predetermined depth around the perimeter of said vent opening; and sealing means attached to said door means, said sealing means extending into said liquid to create a substantially hermetic seal between said door means and said vessel when said door means is in said closed position.

2. The apparatus of claim 1 further comprising means for assisting said door in moving from said closed position to said open position when said predetermined amount of pressure occurs within said vessel.

3. The apparatus of claim 2 wherein said door means is pivotally attached to said vessel and wherein said assisting means comprises at least one counterweight means attached to said door means for assisting said door means in pivoting to said open position upon the occurrence of said predetermined amount of pressure within said vessel.

4. The apparatus of claim 1 further comprising means for maintaining said liquid at said predetermined level.

5. The apparatus of claim 1 wherein said liquid comprises water.

6. The apparatus of claim 1 wherein said liquid comprises a liquid having a freezing point below that of water.

7. The apparatus of claim 1 wherein said liquid has an evaporation point above that of water.

8. The apparatus of claim i further comprising damping means for cushioning said door means when said door means moves to said open position.

9. Apparatus for relieving pressure from an incinerator combustion chamber having a vent duct attached thereto comprising:

a door attached to said vessel and being movable between a closed position wherein said door means is in engagement with said vent duct and an open position remote from said vent opening wherein said vent duct is sufficiently open to relieve pressure within said chamber upon the occurrence of a predetermined amount of pressure within said chamber;

at least one counterweight attached to said door to assist said door in moving from said closed position to said open position;

a liquid holding trough attached around the perimeter of said vent duct for retaining a liquid medium at a predetermined depth therein;

means for maintaining said liquid at said predetermined level within said liquid holding trough; and a sealing member attached around the perimeter of said door such that said sealing member extends into said liquid to achieve a substantially hermetic seal between said door and said vent duct when said door is in said closed position.

* * * * *